US009854894B2

(12) United States Patent
Gruber

(10) Patent No.: US 9,854,894 B2
(45) Date of Patent: Jan. 2, 2018

(54) SCALP PROTECTOR

(71) Applicant: GROOBA Trading GmbH, Steyr (AT)

(72) Inventor: Ronald Gruber, Steyr (AT)

(73) Assignee: GROOBA Trading GmbH, Steyr (AT)

( * ) Notice: Subject to any disclaimer, the term of this patent is extended or adjusted under 35 U.S.C. 154(b) by 40 days.

(21) Appl. No.: 14/402,718

(22) PCT Filed: May 23, 2013

(86) PCT No.: PCT/EP2013/060675
§ 371 (c)(1),
(2) Date: Nov. 21, 2014

(87) PCT Pub. No.: WO2013/174950
PCT Pub. Date: Nov. 28, 2013

(65) Prior Publication Data

US 2015/0101628 A1 Apr. 16, 2015

(30) Foreign Application Priority Data

May 24, 2012 (AT) ..... A 612/2012

(51) Int. Cl.
*A45D 24/04* (2006.01)
*A45D 19/02* (2006.01)
*A45D 44/08* (2006.01)

(52) U.S. Cl.
CPC ..... *A45D 24/04* (2013.01); *A45D 19/02* (2013.01); *A45D 44/08* (2013.01)

(58) Field of Classification Search
CPC ..... A45D 24/04; A45D 24/30; A45D 44/08; A45D 8/12; A01K 13/002; A01K 13/00; A46B 2200/1093; A46B 15/0059
(Continued)

(56) References Cited

U.S. PATENT DOCUMENTS 1,249,552 A * 12/1917 Taflin ..... A01K 13/002 119/611
1,977,920 A * 10/1934 Robinson ..... A45D 2/44 132/128

(Continued)

FOREIGN PATENT DOCUMENTS

DE 295 21 281 U1 11/1996
DE 297 10 572 U1 8/1997

(Continued)

OTHER PUBLICATIONS

International Search Report of PCT/EP2013/060675, dated Sep. 16, 2013.

(Continued)

*Primary Examiner* — Tatiana Nobrega
(74) *Attorney, Agent, or Firm* — Collard & Roe, P.C.

(57) ABSTRACT

A scalp protector for the application of free-flowing hair treatment agents, in which according to the invention a comb-like first bundle of tines (1) protruding from a first web (3) having tines extending essentially parallel to one another is provided, wherein a cover element which adjustably constricts the free space between the tines is provided. The invention therefore represents a mechanical barrier, which is inserted into the hair at the point to be treated and remains there during the duration of the treatment. Since according to the invention a cover element, which adjustably constricts the free space between the teeth, is provided, the cover element can primarily be selected so that the free space is enlarged and easy insertion into the hair is possible. In the further proceedings, the cover element can be adjusted so that the free space is constricted and the scalp is completely covered down to the regions in which the individual hairs aligned in the free space between the tines pass
(Continued)

Figures 1, 2, 3:
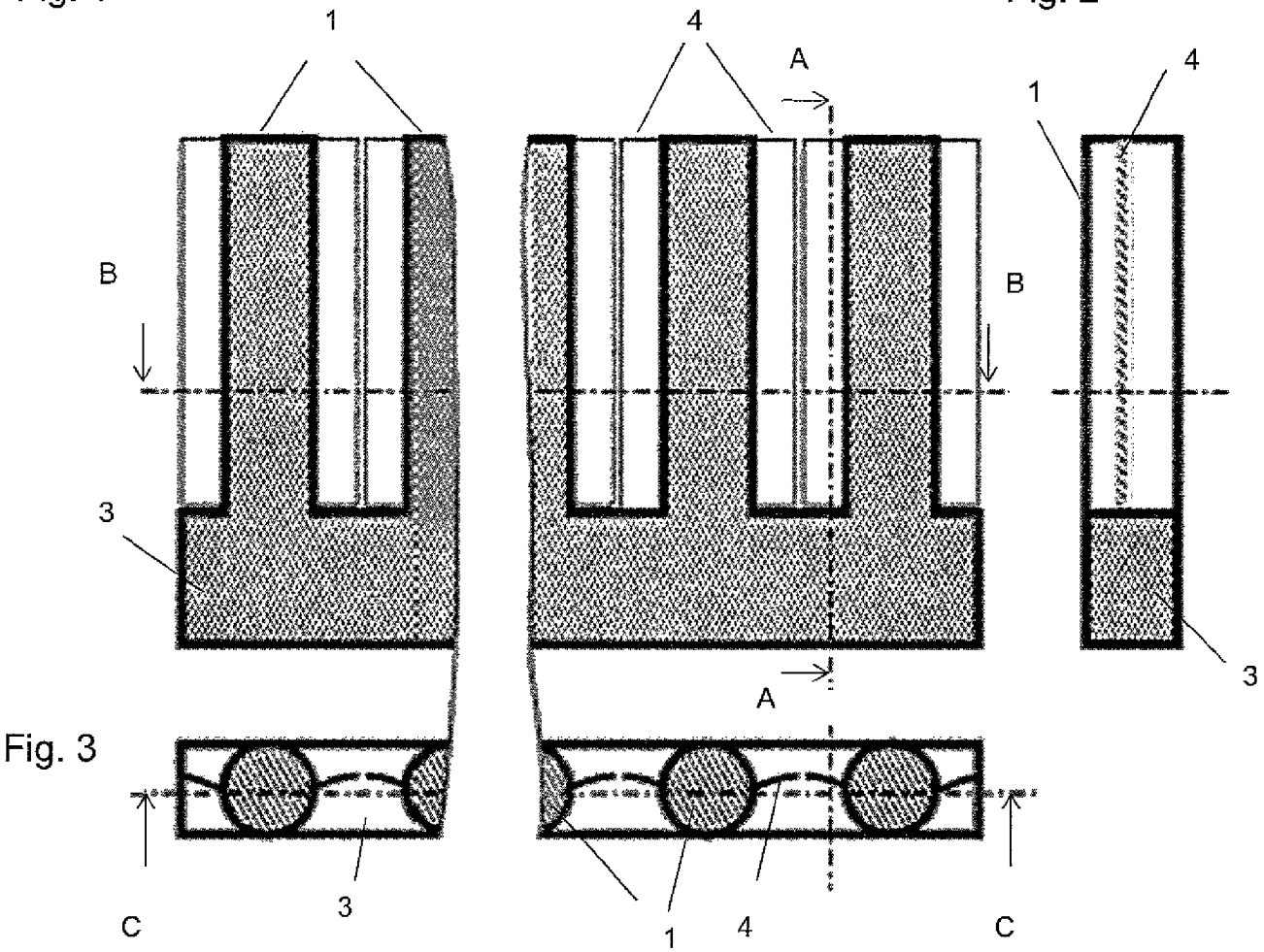

through. Furthermore, different embodiments of the cover element are proposed.

3 Claims, 7 Drawing Sheets

(58) Field of Classification Search
USPC ..... 132/101, 123, 126, 129, 131, 136–138, 132/142, 144, 148, 156, 219; 119/611, 119/613, 616, 625–633
See application file for complete search history.

(56) References Cited

U.S. PATENT DOCUMENTS 1,994,505 A * 3/1935 Dove ..... A45D 24/30 132/137
2,334,737 A * 11/1943 Woodruff ..... A45D 2/44 132/134
2,406,490 A * 8/1946 Day ..... A45D 2/44 132/118
2,533,067 A 12/1950 Taren et al.
2,562,421 A * 7/1951 Hendra ..... A45D 24/36 132/148
3,834,405 A * 9/1974 McCord ..... A42B 7/00 132/101
4,008,726 A * 2/1977 DiGiuseppe ..... A45D 2/44 132/136
4,502,498 A * 3/1985 Saferstein ..... A45D 24/04 132/137
4,807,652 A 2/1989 Bachrach
5,449,007 A * 9/1995 Arnhols ..... A45D 8/12 132/136
5,881,739 A 3/1999 Walker et al.
2004/0045569 A1* 3/2004 Chan ..... A45D 24/10 132/118
2009/0101160 A1* 4/2009 Ruckart ..... A45D 24/04 132/136

FOREIGN PATENT DOCUMENTS

FR 2 694 486 A1 2/1994
GB 6741 A 0/1909
GB 1 118 279 A 6/1968
JP H10 57139 A 3/1998
JP 2002 034637 A 2/2002
WO 93/13689 A1 7/1993
WO 03/022095 A1 3/2003

OTHER PUBLICATIONS

Austrian Search Report in A 612/2012, dated Nov. 22, 2012, with English translation of relevant parts.

* cited by examiner 1
3
4
A
B
C

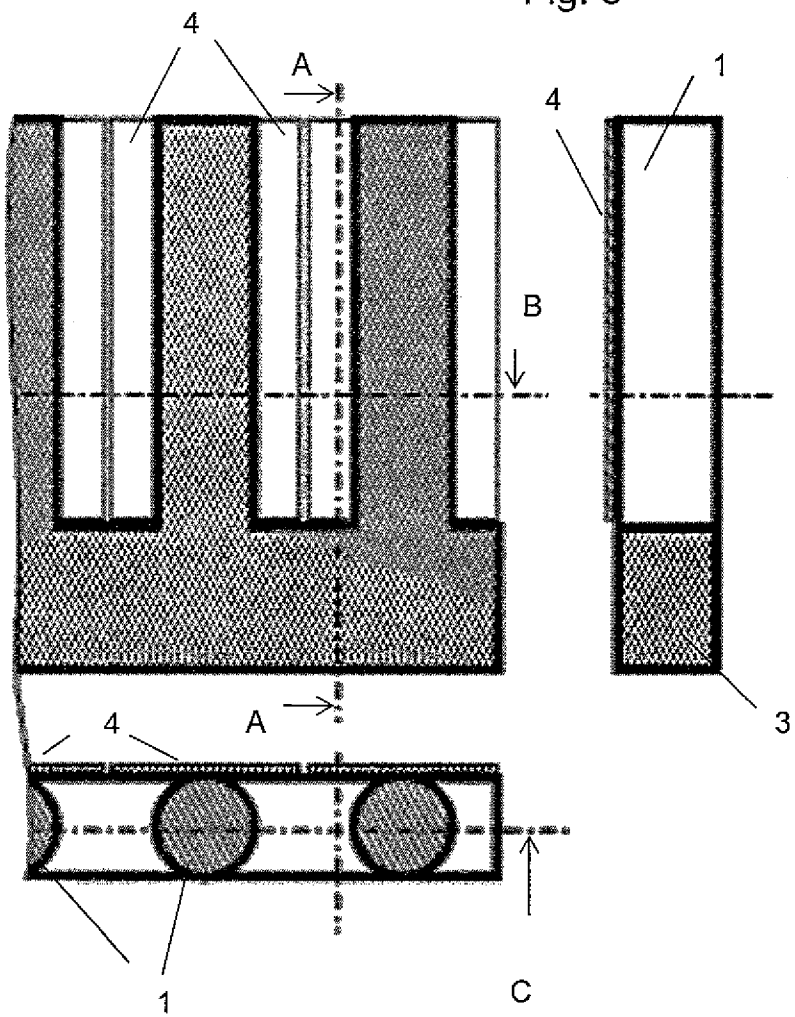
Fig. 5
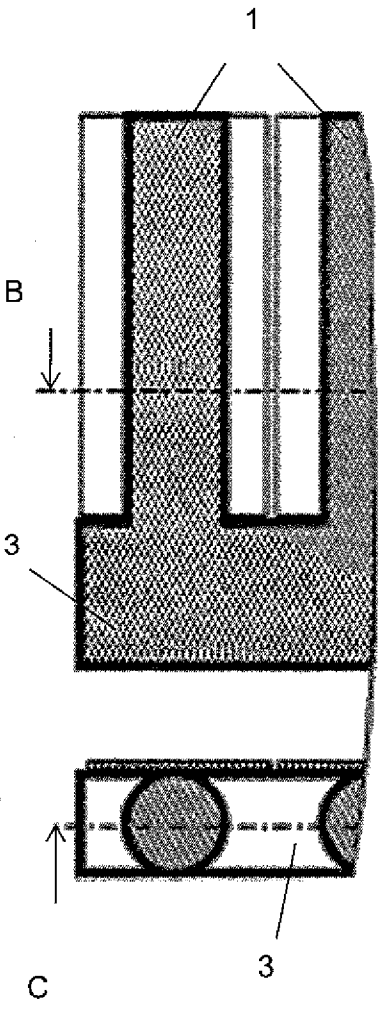
Fig. 4
Fig. 6

A
B
C
1
2
3
5

2
1
5
3
B
A
A
1
2
C

1
B
3
3
5
C

SCALP PROTECTOR

CROSS REFERENCE TO RELATED APPLICATIONS

This application is the National Stage of PCT/EP2013/060675 filed on May 23, 2013, which claims priority under 35 U.S.C. §119 of Austrian Application No. A 612/2012 filed on May 24, 2012, the disclosure of which is incorporated by reference. The international application under PCT article 21(2) was not published in English.

The invention relates to a scalp protector for applying free-flowing hair treatment agents, according to the preamble of Claim 1.

Hair treatment agents, for example, for dyeing, coloring, or bleaching hair, usually include easily oxidizable aromatic compounds and also materials which change the color tone, and which are applied to the hair in the presence of hydrogen peroxide and ammonia, emulsifiers, and water. The hair interior swells during the dyeing operation due to the alkaline medium and the colorant particles diffuse into the hair interior, where they are oxidized to form colorants and chemically bond to the hair keratin. A variety of different compositions of hair treatment agents for dyeing or bleaching hair exist, wherein some of the contained chemicals are suspected of having health-hazardous effects, so that bans for some of these ingredients have already been enacted to different extents on the part of the lawmakers in different countries.

An effective protection for the scalp in relation to possibly health-hazardous substances in hair treatment agents is presently not known. It is therefore the object of the invention to implement a corresponding scalp protector for applying free-flowing hair treatment agents, which reliably protects the scalp of the user against the effect of harmful chemicals, on the one hand, but is also simple to apply and does not impair the treatment of the hair, on the other hand.

These objects are achieved by the features of Claim 1. Claim 1 proposes, for a scalp protector for the application of free-flowing hair treatment agents, that a comb-like first bundle of tines, which protrudes from a first web, having tines extending essentially parallel to one another is provided, wherein a cover element which adjustably constricts the free space between the tines is provided. The invention therefore represents a mechanical barrier, which is inserted into the hair at the point to be treated and remains there during the duration of the treatment. Since according to the invention a cover element which adjustably constricts the free space between the tines is provided, the cover element can initially be selected so that the free space is enlarged and easy insertion into the hair is possible. In the further proceedings, the cover element can be adjusted so that the free space is constricted and the scalp is completely covered except for those areas in which the individual hairs aligned in the free space between the tines pass through. The concept of adjustability is to be understood in this context so that any manipulation of the scalp protector by an external force action is meant, i.e., for example, by the hand of the user, by a brush, or also by the hair itself, for example, in the course of its swelling. The implementation of a cover element which adjustably constricts the free space between the teeth also has the advantage that the tines can be selected to be thicker and therefore have sufficient stiffness for easy insertion into the hair. Specifically, if the tines are selected to be thicker, the tine distance must also be selected to be greater, to enable easy insertion into the hair. An enlarged tine distance reduces the protection of the scalp in the free space between the tines, however. This disadvantage is avoided by the cover element according to the invention. A further advantage of the adjustable cover element is also that after the application of the hair treatment agent, the cover element can again be adjusted so that the free space between the tines is enlarged. During the action time of dyeing and bleaching agents, for example, the hair swells up and could therefore be pinched between the tines of the scalp protector, whereby the hair can be damaged and tends to break off at the bending points after action of the dyeing agent. However, if the free space between the tines is enlarged, a pinching situation can be avoided.

In this case, the first bundle of tines and the first web are preferably manufactured from a plastically deformable material, so that it can be adapted well to the shape of the head in the treated section and can also remain in this bent position.

There are different possibilities for the embodiment of the cover element. Thus, it could be embodied in the form of pivotable lamellae, for example, which are arranged along the longitudinal extension of the tines and protrude into the free space between the tines. These lamellae can be fastened or molded on the tines and are embodied in the form of thin "membranes". Because of their low thickness, they have an ability to pivot about a pivot axis which is parallel to the longitudinal axis of the tines, so that depending on the position of the lamellae, the free space between the tines is constricted more or less.

According to a further embodiment, the cover element can also be embodied as a comb-like second bundle of tines, which protrudes elastically from a second web, having tines extending essentially parallel to one another and in the free space between the tines of the first bundle of tines in relation to the tines of the first bundle of tines, wherein the plane of the second bundle of tines is arranged at a slight standard distance to the plane of the first bundle of tines. In particular, the tines of the first bundle of tines can have a cross section which tapers in the direction of the second bundle of tines. The adjustable constriction of the free space is provided in this embodiment via the elasticity of the tines of the second bundle of tines and the cross section, which tapers in the direction of the second bundle of tines, of the tines of the first bundle of tines. The tines of the first bundle of tines preferably have a triangular cross section.

According to a further embodiment, it is provided that the cover element is embodied as a comb-like second bundle of tines, protruding from a second web, having tines extending essentially parallel to one another and to the tines of the first bundle of tines, wherein the second bundle of tines is mounted so it is displaceable on the first web in the longitudinal direction of the tines within the free space between the tines of the first bundle of tines.

Depending on whether the tines of the second bundle of tines are pushed between the tines of the first bundle of tines, the free space is constricted or enlarged.

An alternative embodiment provides that the cover element is embodied as a comb-like second bundle of tines protruding from a second web, having tines extending essentially parallel to one another and parallel to the tines of the first bundle of tines, wherein the second web is arranged so it is displaceable on the first web transversely to the longitudinal extension of the tines. The adjustable constriction of the free space is therefore divided in this embodiment via the displacement of the second bundle of tines transversely to the longitudinal extension of the tines, preferably perpendicularly to the longitudinal extension of the tines, in the free space between the tines of the first bundle of tines.

In the two last-mentioned embodiment variants, the tines of the first or second bundle of tines can again have a triangular cross section. In this case, the cross section of the tines preferably tapers in the usage position in the direction of the hair tips, so that two adjacent tines form a funnel-shaped arrangement, in which the hair dyeing agent can enter well and the hair is therefore wetted up to close to the scalp. However, it is fundamentally to be noted that human hair also has a certain absorbency for typical hair treatment agents, so that it does not have to be exposed entirely up to the scalp to also enable the dyeing of the hair close to the scalp.

The displaceability of the two webs perpendicularly to the longitudinal direction of the tines can either take place in parallel to the plane of the first bundle of tines, or perpendicularly to this plane. It is preferably provided that the second web is arranged so it is displaceable on the first web perpendicularly to the plane of the first bundle of tines. This has the advantage that only two tine planes are necessary to sufficiently cover the scalp. In the case of displaceability in parallel to the plane of the first bundle of tines, at least three planes are necessary for fixation of the hair and therefore good coverage of the scalp, to sufficiently pinch the individual hairs. In addition, the displacement perpendicular to the plane of the first bundle of tines enables a displacement in the hair growth direction, so that it does not have to be bent during the covering of the scalp, which would be necessary in the case of a displacement in parallel to the plane of the first bundle of tines. The hair can thus be dyed down to its lowermost hair portions. The tines of the second tine plane can additionally be displaced up into the plane of the first bundle of tines, so that they are approximately or entirely in the same plane. Such a well-sealing configuration would hardly be possible in the case of displaceability of the tines in parallel to the tine planes. If the plane of the first bundle of tines is embodied as curved, the perpendicular direction relates to a corresponding tangential plane. If the first web is embodied as curved in the plane of the first bundle of tines, the tines of the first and second bundles of tines no longer extend parallel to one another, but rather slightly diverge radially from the first and second webs. Such a course of the tines is also understood in this application as an "essentially parallel" course of the tines, however.

For the case of displaceability of the second web perpendicularly to the plane of the first bundle of tines, it is furthermore proposed that the second web is fastened on the first web with the aid of a manually detachable locking element, which fixes the plane of the second bundle of tines at variable standard distances to the plane of the first bundle of tines. The locking element can be embodied as a catch rail, for example, which is arranged on the first web, for example, and in which a catch part of the second web engages in different positions. The first and second webs therefore latch on one another at different standard distances of the first and second bundles of tines.

The displaceability of the second web perpendicular to the plane of the first bundle of tines has the further advantage that the first web can be embodied as curved in two spatial directions. In the case of such more complex geometry, which enables good adaptation to the head shape, however, a relative displaceability of the two tine planes is also easy to implement in the case of a perpendicular displaceability.

A further embodiment provides that the tines of the first bundle of tines are arranged so they are pivotable about their longitudinal axis on the first web, and the cover element is formed by a cross-sectional expansion of the tines of the first bundle of tines. The tines can have an elliptical cross section, for example, so that in the case of perpendicular alignment of the main axes of the tines to the plane of the first bundle of tines, an enlarged free space is provided between the tines, and upon pivoting of the tines by 90°, the free space is constricted.

According to a further embodiment, it is provided that the cover element is formed by inflatable chambers, which are arranged along the longitudinal extension of the tines of the first bundle of tines and extend in the inflated space into the free space between the tines of the first bundle of tines. In this case, the inflatable chambers can be arranged on both sides of the tines and can be connected via an air supply to a hand pump, or the inflatable chambers enclose the tines.

In a preferred embodiment, the first bundle of tines and the first web and/or the second bundle of tines and the second web are manufactured from a plastically deformable material.

Figures 7, 8, 9, 10:
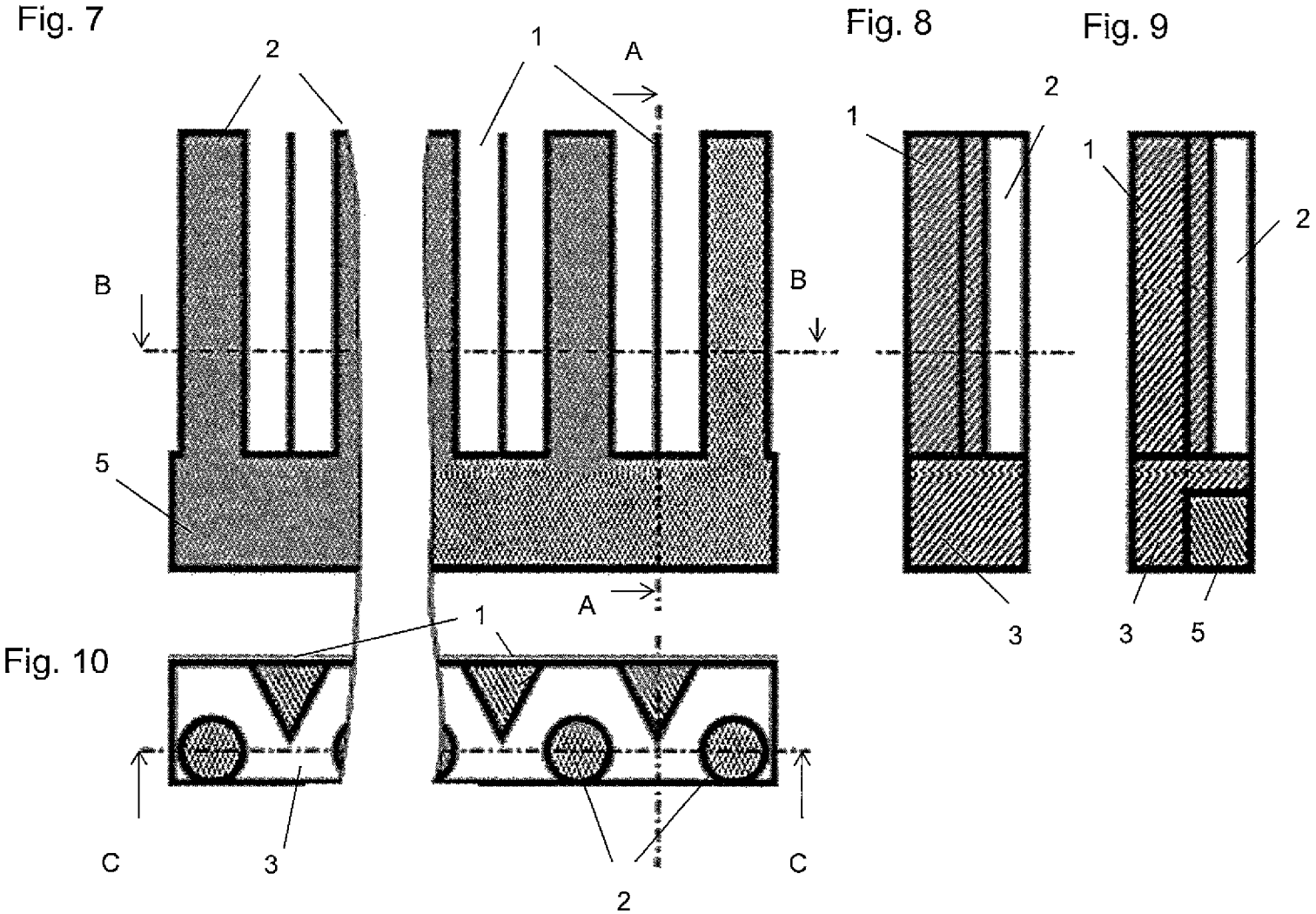
Figures 11, 12, 13:
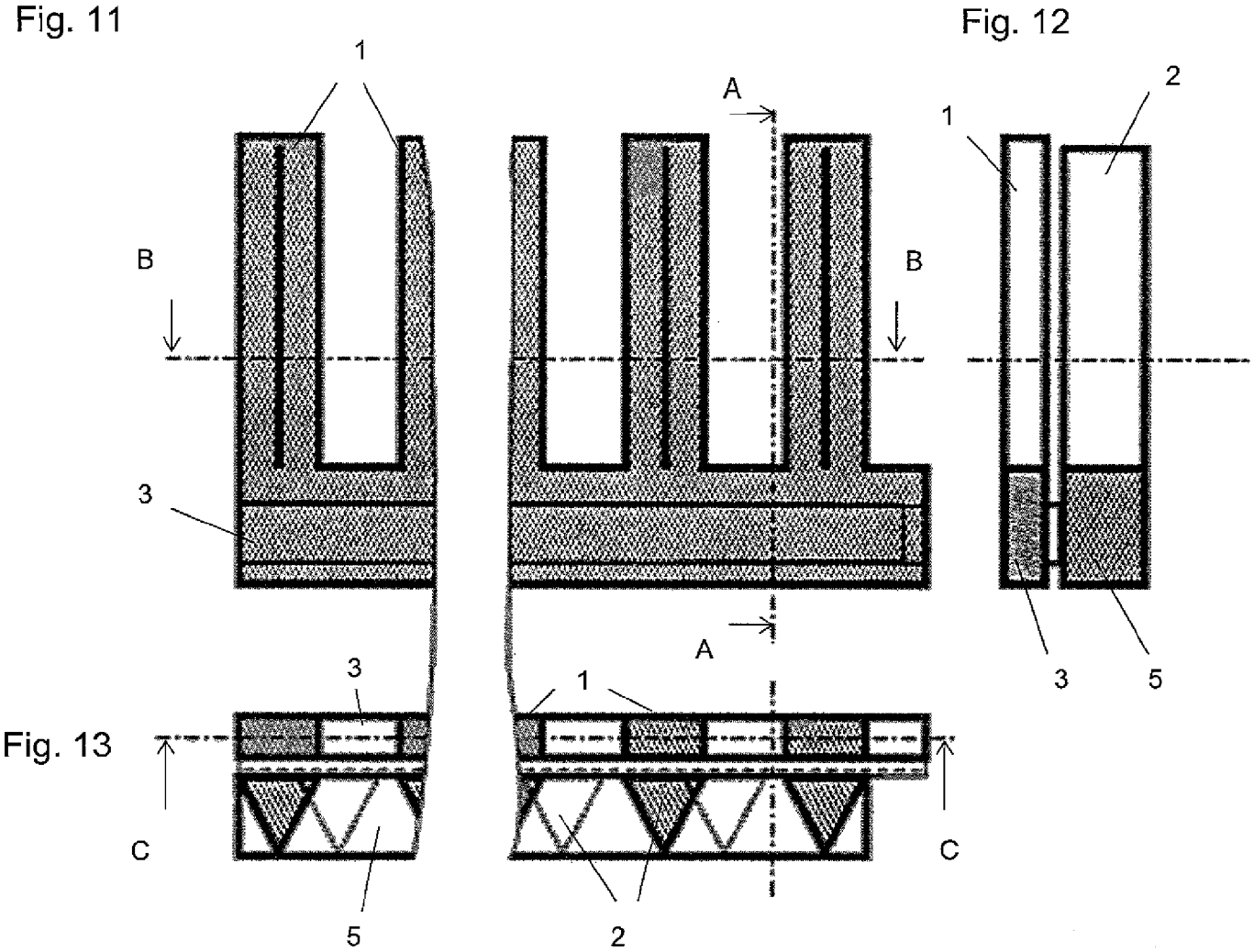
Figures 14, 15, 16:
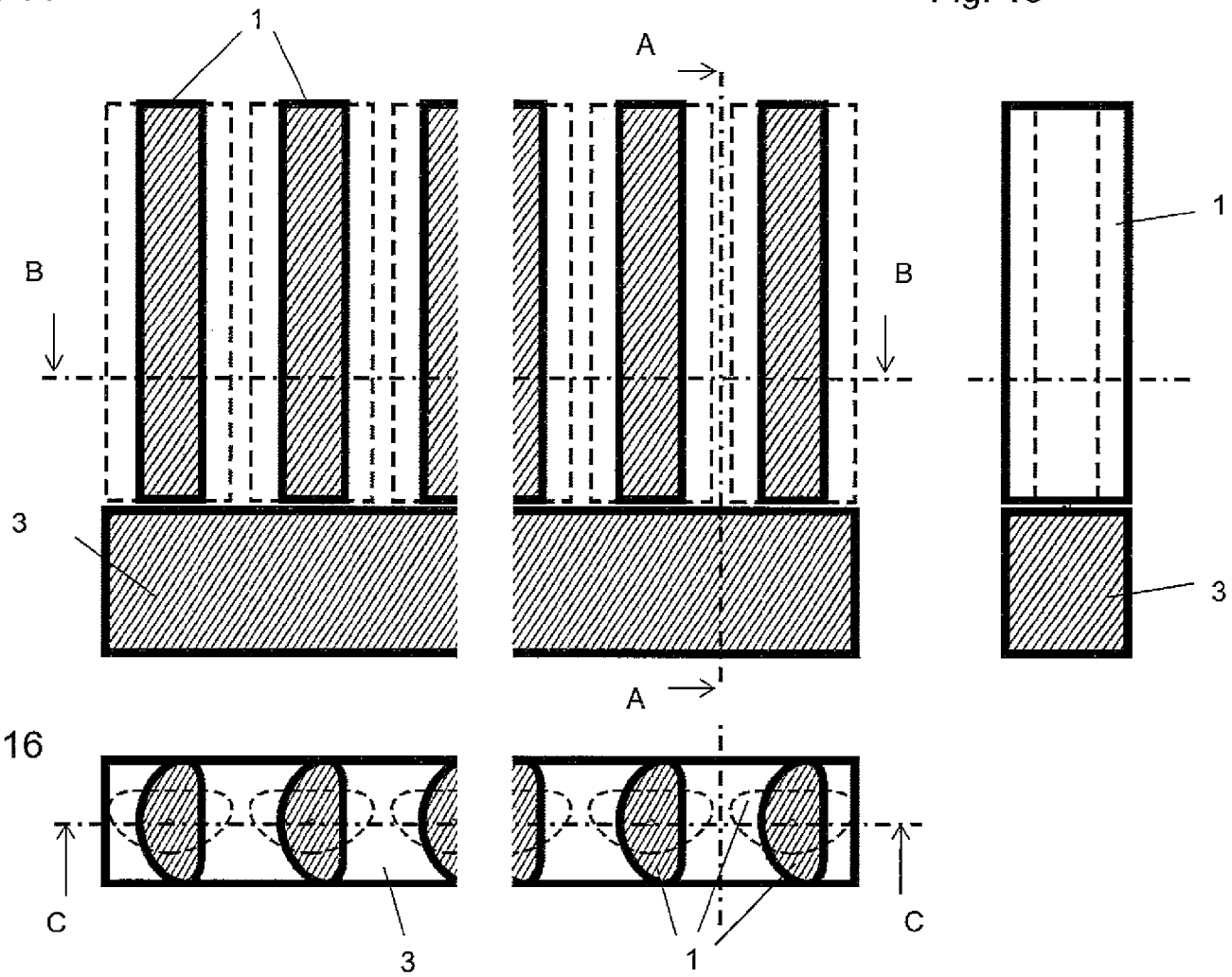
Figures 17, 18, 19:
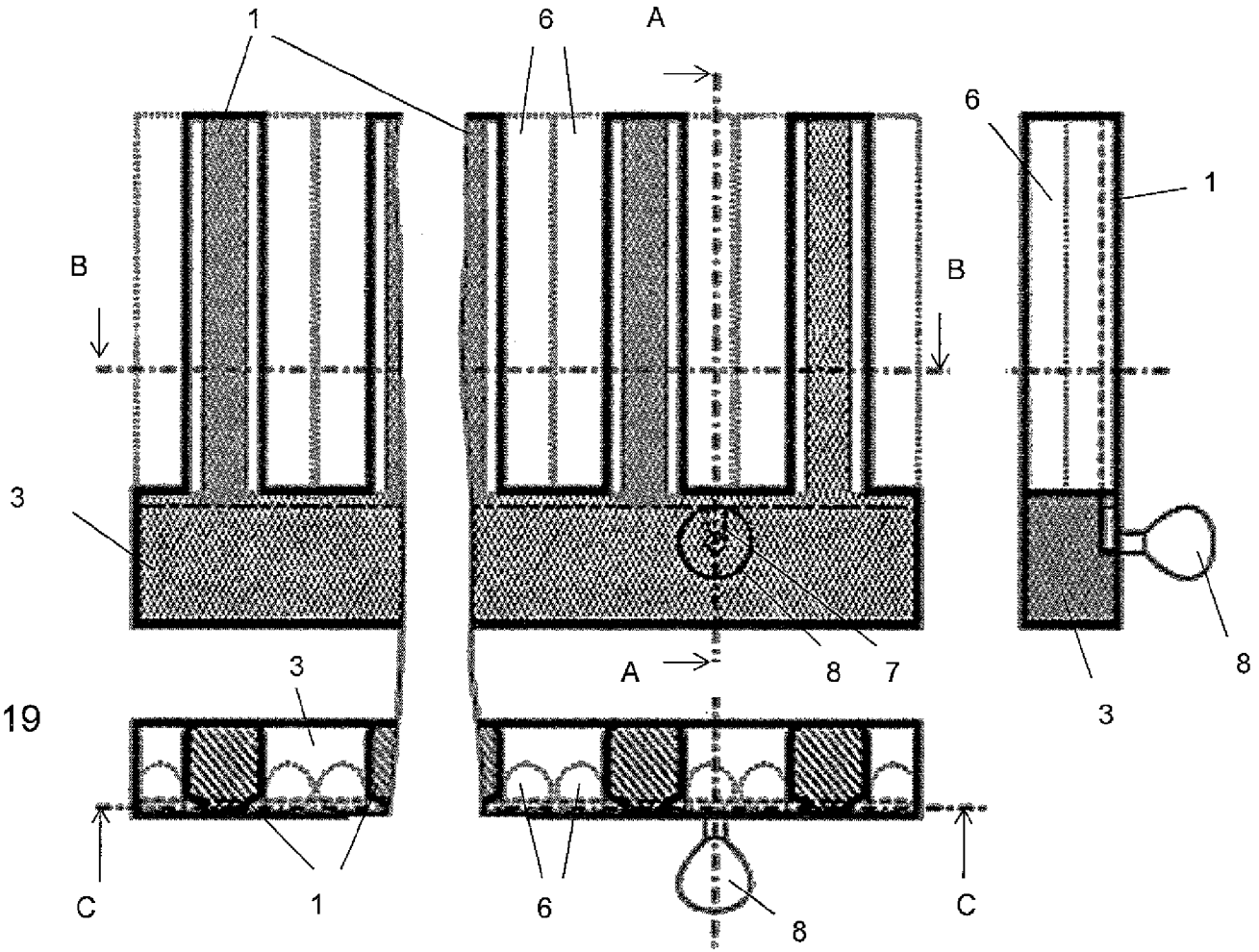
Figure 21:
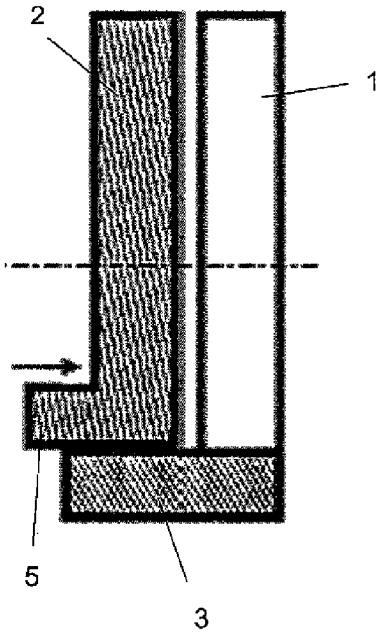
Figure 20:
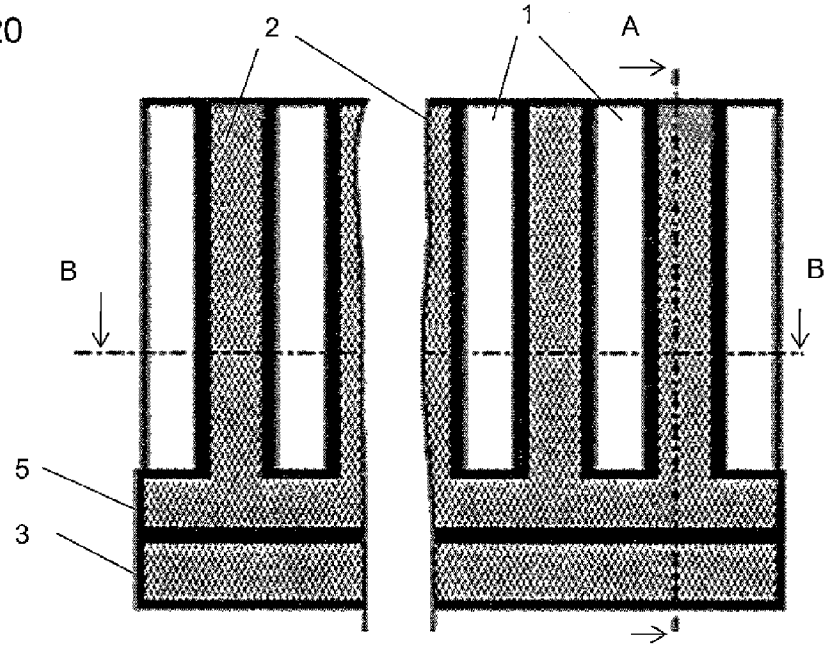
Figure 22:
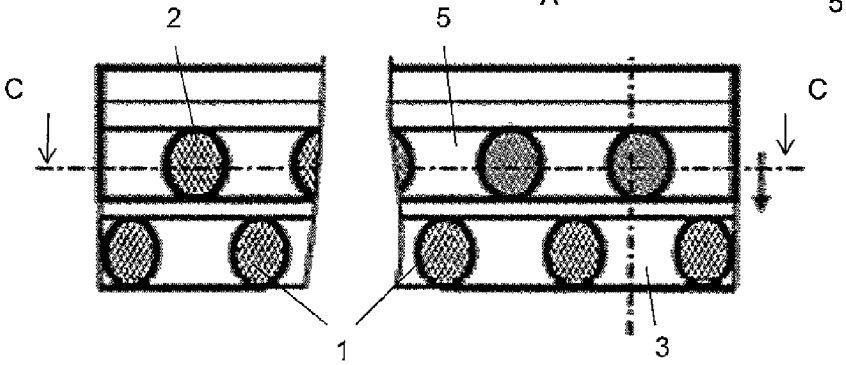

The invention will be explained in greater detail hereafter on the basis of exemplary embodiments with the aid of the appended figures. In the figures:

FIG. 1 shows a section along plane C-C (see FIG. 3), through a portion of a first embodiment of the scalp protector according to the invention, in which the comb-like structure is visible, FIG. 2 shows a section through the scalp protector according to FIG. 1 along plane A-A, FIG. 3 shows a section through the scalp protector according to FIG. 1 along plane B-B, FIG. 4 shows a section along plane C-C (see FIG. 6) through a section of a second embodiment of the scalp protector according to the invention, in which the comb-like structure is visible, FIG. 5 shows a section through the scalp protector according to FIG. 4 along plane A-A, FIG. 6 shows a section through the scalp protector according to FIG. 4 along plane B-B, FIG. 7 shows a section along plane C-C (see FIG. 10) through a section of a further embodiment of the scalp protector according to the invention, in which the comb-like structure is visible, FIG. 8 shows a section through the scalp protector according to FIG. 7 along plane A-A for a third embodiment, FIG. 9 shows a section through the scalp protector according to FIG. 7 along plane A-A for a fourth embodiment, FIG. 10 shows a section through the scalp protector according to FIG. 7 along plane B-B, FIG. 11 shows a section along plane C-C (see FIG. 13) through a section of a fifth embodiment of the scalp protector according to the invention, in which the comb-like structure is visible, FIG. 12 shows a section through the scalp protector according to FIG. 11 along plane A-A, FIG. 13 shows a section through the scalp protector according to FIG. 11 along plane B-B, FIG. 14 shows a section along plane C-C (see FIG. 16) through a section of a sixth embodiment of the scalp protector according to the invention, in which the comb-like structure is visible, FIG. 15 shows a section through the scalp protector according to FIG. 14 along plane A-A, FIG. 16 shows a section through the scalp protector according to FIG. 14 along plane B-B, FIG. 17 shows a section along plane C-C (see FIG. 19) through a section of a further embodiment of the scalp protector according to the invention, in which the comb-like structure is visible, FIG. 18 shows a section through the scalp protector according to FIG. 17 along plane A-A, FIG. 19 shows a section through the scalp protector according to FIG. 17 along plane B-B, FIG. 20 shows a section along plane C-C (see FIG. 22) through a section of a sixth embodiment of the scalp protector according to the invention, in which the comb-like structure is visible, FIG. 21 shows a section through the scalp protector according to FIG. 20 along plane A-A, and FIG. 22 shows a section through the scalp protector according to FIG. 20 along plane B-B.

Firstly, reference is made to FIGS. 1 to 3. FIG. 1 shows a section through a portion of a first embodiment of the scalp protector according to the invention having tines, which form a first bundle of tines 1, arranged essentially parallel to one another on a first web 3. A free space remains in each case between the tines of the first bundle of tines 1. The invention therefore fundamentally represents a mechanical barrier in relation to the possibly health-hazardous substances of the hair treatment agent, which is inserted into the hair at the point to be treated and remains there during the duration of the treatment. The tines must have sufficient stiffness for easy insertion into the hair and therefore also a material-dependent minimum thickness. The tine distance must accordingly be selected to be larger, to enable easy insertion into the hair, for example, 2-3 mm. An enlarged tine distance reduces the protection of the scalp in the free space between the tines, however. This disadvantage is avoided by the cover element according to the invention.

According to FIGS. 1-3, the cover element is embodied, for example, in the form of pivotable lamellae 4, which are arranged along the longitudinal extension of the tines and protrude into the free space between the tines. These lamellae 4 can be fastened or molded on the tines and are embodied in the form of thin "membranes". Because of their low thickness, they have an ability to pivot about a pivot axis parallel to the longitudinal axis of the tines, so that depending on the position of the lamellae 4, the free space between the tines is constricted more or less. As the scalp protector is inserted and pressed against the scalp, these lamellae 4 are bent away from the scalp. The lamellae 4 can also be preshaped to be curved, as is visible in FIG. 3, for example. If the hair treatment agent is now applied using the brush, the lamellae 4 are bent by the brush pressure in the direction of the scalp (downward in relation to FIG. 3), and the free space is constricted, so that in this phase good protection of the scalp is ensured. During the action time, the hair swells up and presses the lamellae 4 away from the scalp again (upward in relation to FIG. 3), so that the free space is enlarged and pinching of the hairs is avoided.

An alternative embodiment with the aid of lamellae 4 is visible in FIGS. 4-6, in which the lamellae 4 are fastened on the lower side of the tines of the first bundle of tines 1 and protrude on both sides of the tines in the transverse direction of the tines. If the lamellae 4 are embodied from a dense plastic, in such an embodiment, an absorbent material could be selected for the tines. In this case, the tines absorb the hair treatment agent and discharge it again at those regions of the hair just above the scalp, which otherwise would not be wetted by the brush.

The diameter of the tines can be embodied differently in the two above-mentioned embodiments, i.e., circular, elliptical, rectangular, or also triangular.

A further embodiment is shown in FIGS. 7, 8, and 10. In this case, the cover element is embodied as a comb-like, protruding second bundle of tines 2 having tines extending essentially parallel to one another and to the tines of the first bundle of tines 1 in the free space between the tines of the first bundle of tines 1, wherein the plane of the second bundle of tines 2 is arranged at a slight standard distance to the plane of the first bundle of tines 1, and the tines of the first bundle of tines 1 have a cross section which tapers in the direction of the second bundle of tines 2. The concept of the "plane" of the first bundle of tines 1 or the second bundle of tines 2 is understood in this case to mean that it is defined in a section perpendicular to the longitudinal extension of the tines, as is visible in FIG. 10, for example, by the surface focal points of the cross sections of the individual tines. The adjustable constriction of the free space is provided in this embodiment via the elasticity of the tines of the second bundle of tines 2 and the cross section, which tapers in the direction of the second bundle of tines 2, of the tines of the first bundle of tines 1. The tines of the first bundle of tines 1 preferably have a triangular cross section, as shown in FIG. 10, for example. The tines of the second bundle of tines 2 can therefore be pressed into the free space between the tines of the first bundle of tines 1, whereby the free space is constricted, or can be lifted off thereof, whereby the free space is enlarged. As the scalp protector is inserted and pressed against the scalp, the tines of the second bundle of tines 2 are firstly bent away from the scalp (downward in relation to FIG. 10) and the free space is enlarged. If the hair treatment agent is now applied using the brush, the tines of the second bundle of tines 2 are bent by the brush pressure in the direction of the scalp (upward in relation to FIG. 10), and the free space is constricted, so that in this phase good protection of the scalp is ensured. During the action time, the hair swells up and presses the tines of the second bundle of tines 2 away from the scalp again, so that the free space is enlarged and pinching of the hairs is avoided.

FIG. 8 shows for this purpose a section through the scalp protector according to FIG. 7 along the plane A-A for a third embodiment, in which the web of the second bundle of tines 2 is fixedly connected to the first web 3 of the first bundle of tines 1, or is also molded in one piece with it. FIG. 9, in contrast, shows an embodiment in which the second bundle of tines 2 protrudes from a second web 5 and is mounted so it is displaceable on the first web 3 in the longitudinal direction of the tines within the free space between the tines of the first bundle of tines 1. Depending on whether the tines of the second bundle of tines 2 are pushed between the tines of the first bundle of tines 1, the free space is constricted or enlarged. The adjustable constriction of the free space is therefore provided in this embodiment via the pushing of the second bundle of tines 2 into the free space between the tines of the first bundle of tines 1. As the scalp protector is inserted and pressed against the scalp, the tines of the second bundle of tines 1 are initially not yet pushed in and the free space is therefore enlarged. Before the hair treatment agent is now applied using the brush, the tines of the second bundle of tines 2 are pushed in in the longitudinal direction of the tines and the free space is thus constricted, so that good protection of the scalp is ensured in this phase. During the action time, the tines of the second bundle of tines 2 can be pushed out again, so that the free space is enlarged and pinching of the hairs is avoided.

A further embodiment of the scalp protector according to the invention will be explained on the basis of FIGS. 11-13. In this case, the cover element is embodied as a comb-like second bundle of tines 2 protruding from a second web, having tines extending essentially parallel to one another and to the tines of the first bundle of tines 1, wherein the plane of the second bundle of tines 2 is arranged at a slight standard distance to the plane of the first bundle of tines 1, and the second web 5 is arranged so it is displaceable on the first web 1 transversely to the longitudinal extension of the tines. FIG. 13 shows a displaced position of the second bundle of tines 2 in the form of dashed lines. The concept of the "plane" of the first bundle of tines 1 or the second bundle of tines 2 is again understood in this case so that in a section perpendicular to the longitudinal extension of the tines, for example, as is visible in FIG. 13, it is defined by the surface focal points of the cross sections of the individual tines. The adjustable constriction of the free space is therefore provided in this embodiment via the displacement of the second bundle of tines 2 transversely to the longitudinal extension of the tines, preferably perpendicularly to the longitudinal extension of the tines, in the free space between the tines of the first bundle of tines 1. As the scalp protector is inserted and pressed against the scalp, the tines of the second bundle of tines 2 are firstly not yet pushed in and the free space is therefore enlarged. Before the hair treatment agent is now applied using the brush, the tines of the second bundle of tines 2 are displaced transversely to the longitudinal direction of the tines and the free space is thus constricted (see dashed position in FIG. 13), so that in this phase good protection of the scalp is ensured. During the action time, the tines of the second bundle of tines can again be displaced, so that the free space is enlarged and pinching of the hairs is avoided.

A further embodiment is shown in FIGS. 14-16. It is provided in this case that the tines of the first bundle of tines 1 are arranged so they are pivotable about their longitudinal axis on the first web 3, and the cover element is formed by a cross-sectional expansion of the tines of the first bundle of tines 1. In the exemplary embodiment shown, the tines have an approximately elliptical cross section, so that in the case of perpendicular alignment of the main axes of the tines to the plane of the first bundle of tines 1, an enlarged free space is provided between the tines, and upon pivoting of the tines by up to 90°, the free space is constricted. As the scalp protector is inserted and pressed against the scalp, the tines of the first bundle of tines 1 are initially aligned so that the cross-sectional expansion is arranged perpendicularly to the plane of the bundle of tines 1 and the free space is therefore enlarged. This position is shown in FIGS. 14-16 using solid lines. Before the hair treatment agent is now applied using the brush, the tines of the bundle of tines are pivoted by approximately 90°, so that the cross-sectional expansion is pivoted into the plane of the bundle of tines and the free space is thus constricted, so that in this phase good protection of the scalp is ensured. This position is shown in FIGS. 14-16 using dashed lines. During the action time, the tines of the bundle of tines can be pivoted back into the starting location, to enlarge the free space and avoid pinching of the hairs during the swelling.

According to a further embodiment, it is provided that the cover element is formed by inflatable chambers 6, which are arranged along the longitudinal extension of the tines of the first bundle of tines 1 and extend in the inflated state into the free space between the tines of the first bundle of tines 1. This embodiment is shown in FIGS. 17-19. In this case, the inflatable chambers 6 can be arranged on both sides of the tines, or the inflatable chambers 6 enclose the tines. In both cases, the inflatable chambers 6 are connected via an air supply 7 to a hand pump 8, an inflation bellows, or the like. As the scalp protector is inserted and pressed against the scalp, the inflatable chambers 6 are initially not inflated, so that the free space between the tines is enlarged. Before the hair treatment agent is now applied using the brush, the chambers 6 are inflated, for example, by brief actuation of a hand pump 8 or an inflation bellows, so that the free space is therefore constricted and good protection of the scalp is ensured. During the action time, the inflatable chambers 6 have sufficient elasticity to avoid pinching of the hairs during the swelling. However, a mechanism could additionally be provided for evacuating the chambers 6, to rapidly enlarge the free space between the tines of the bundle of tines 1.

A further embodiment is shown in FIGS. 20-22. It is provided in this case that the second web 5 is arranged so it is displaceable on the first web 3 perpendicularly to the plane of the first bundle of tines 1, so that the standard distance of tines of the first bundle of tines 1 to tines of the second bundle of tines 2 is variable. In the exemplary embodiment shown, the tines have an approximately elliptical cross section. As the scalp protector is inserted and pressed against the scalp, the tines of the second bundle of tines 2 are initially spaced apart from the tines of the first bundle of tines 1 in the perpendicular direction, so that the free space between the tines is therefore enlarged. Before the hair treatment agent is now applied using the brush, the second web 5 is thus displaced in the perpendicular direction so that the tines of the second bundle of tines 2 move toward the tines of the first bundle of tines 1, so that the standard distance of the first bundle of tines 1 to the second bundle of tines 2 is decreased. This movement direction is indicated in FIGS. 21 and 22 with an arrow. The free space between the tines was thus constricted, so that in this phase good protection of the scalp is ensured. It could even be provided that the tines of the second tine plane are displaced up into the plane of the first bundle of tines, so that they approximately or entirely lie in the same plane. During the action time, the tines of the bundle of tines can be displaced back into the starting location, to enlarge the free space and avoid pinching of the hairs during the swelling.

The second web 5 can be fastened in this case on the first web 3 with the aid of a manually detachable locking element, which fixes the plane of the second bundle of tines 2 at variable standard distances to the plane of the first bundle of tines 1. The locking element can be embodied as a catch rail, for example, which is arranged on the first web 3, for example, and in which a catch part of the second web 5 engages in different positions. The first web 3 and the second web 5 therefore latch on one another in different standard distances of the first and second bundles of tines 1, 2. Furthermore, a spring element could also be provided, which moves the second web 5 back into its starting location, in which the plane of the second bundle of tines 2 is again spaced apart from that of the first bundle of tines 1, upon disengagement of the locking.

With the aid of the invention, a scalp protector for the application of free-flowing hair treatment agent is therefore implemented, which reliably protects the scalp of the user against the action of harmful chemicals, on the one hand, but is also simple to apply and does not impair the treatment of the hair, on the other hand.

The invention claimed is:

1. A scalp protector for the application of a free-flowing hair treatment agent, the scalp protector comprising:

a first row of tines (1) protruding from a first support portion (3) and extending parallel to one another;

a cover element having a second support portion fastened to the first support portion and a second row of tines extending parallel to one another and protruding from the second support portion, where the second row of tines is positioned above and parallel to the first row of tines such that there is free space between the tines of the first and second rows of tines, and the second support portion displaces perpendicularly on the first support portion (3) with respect to a plane extending through the first row of tines and the first support portion such that the free space adjustably constricts;

wherein the first row of tines and first support portion are made of a material which adapts and bends to the shape of the head in a treatment section thereof and remains in the bent position after force is removed; and in use, the scalp protector is inserted and pressed against the scalp at a treatment section, the second support portion (5) is displaced in the perpendicular direction so that the tines of the second row of tines (2) move toward the tines of the first row of tines (1) and the free space between the tines of the first and second rows of tine is constricted before the hair treatment agent is applied and the scalp protector remains at the treatment section of the scalp during the duration of the treatment, representing a mechanical barrier for the hair treatment agent such that protection of the scalp is ensured.

2. The scalp protector according to claim 1, wherein the second support portion is fastened to the first support portion by a manually detachable locking element which fixes a plane extending through the second row of tines and the second support portion at variable standard distances to the plane of the first row of tines.

3. The scalp protector according to claim 1, wherein the first support portion (3) is curved in two spatial directions.

* * * * *